US005248925A

United States Patent [19]

Jornot

[11] Patent Number: 5,248,925

[45] Date of Patent: Sep. 28, 1993

[54] DRAFTING ARRANGEMENT WITH FEEDBACK DRIVE GROUPS

[75] Inventor: Erich Jornot, Seuzach, Switzerland

[73] Assignee: Rieter Machine Works, Ltd., Winterthur, Switzerland

[21] Appl. No.: 885,245

[22] Filed: May 20, 1992

Related U.S. Application Data

[63] Continuation of Ser. No. 552,491, Jul. 16, 1990, abandoned.

[30] Foreign Application Priority Data

Jul. 31, 1989 [CH] Switzerland ..... 02834/89

[51] Int. Cl.[5] ..... G05B 1/06

[52] U.S. Cl. ..... 318/628; 318/640; 318/562; 19/239; 19/240

[58] Field of Search ..... 318/560–646, 318/480, 34–78; 19/0.39, 0.56, 0.58, 0.6, 150, 236, 239, 240, 244, 249, 252, 256, 258, 265, 268, 270, 271, 280, 282, 286, 288, 300; 57/264, 58.36, 58.61, 58.83, 58.84, 92, 93, 94, 95, 81, 100

[56] References Cited

U.S. PATENT DOCUMENTS

| | | | |
|---|---|---|---|
| 3,925,850 | 12/1975 | Lytton | 19/150 X |
| 3,958,305 | 5/1976 | Felix et al. | 19/240 X |
| 4,038,723 | 8/1977 | Felix | 19/240 X |
| 4,336,684 | 6/1982 | Hartmannsgruber et al. | 19/293 X |
| 4,369,550 | 1/1983 | Meile | 19/240 |
| 4,473,924 | 10/1984 | Hartmannsgruber et al. | 19/239 |
| 4,494,204 | 1/1985 | Hosel | 19/240 X |
| 4,506,414 | 3/1985 | Krieger | 19/240 |
| 4,512,061 | 4/1985 | Hartmannsgruber et al. | 19/239 |
| 4,589,168 | 5/1986 | Krieger | 19/240 |
| 4,653,153 | 3/1987 | Felix et al. | 19/240 |
| 4,703,431 | 10/1987 | Sako et al. | 19/240 X |
| 4,807,430 | 2/1989 | Palmer | 57/18 |
| 4,812,993 | 3/1989 | Konig et al. | 19/239 X |
| 4,819,301 | 4/1989 | Konig et al. | 19/240 |
| 4,864,694 | 9/1989 | Konig et al. | 19/239 X |
| 4,974,296 | 12/1990 | Vidler | 19/239 |
| 4,987,734 | 1/1991 | Meyer | 19/258 X |
| 5,022,123 | 6/1991 | Ueda | 19/260 |

FOREIGN PATENT DOCUMENTS

| | | |
|---|---|---|
| 3622584 | 1/1988 | Fed. Rep. of Germany . |
| 2521597 | 8/1983 | France . |
| 59-187629 | 10/1984 | Japan . |
| 2062712 | 5/1981 | United Kingdom . |

*Primary Examiner*—Paul Ip

*Attorney, Agent, or Firm*—Sandler Greenblum & Bernstein

[57] ABSTRACT

A draw frame with a main control for a drafting arrangement having at least one independent drive group for at least one drafting zone. Each independent drive group has an auxiliary closed loop control system having a controller. Fiber slivers are drawn through the drafting arrangement through the drafting zones. When the control the range of a certain controller is exceeded, a nominal adjustment of at least one drive group is effected through a control connection.

8 Claims, 2 Drawing Sheets

GEAR UNIT OR DRIVE
DRIVE
DRIVE
CONTROLLER
CONTROLLER
CENTRAL COMPUTER
v1 = v2 < v3 = v4 < v5 = v6
vin
vout
15.1-15.6
9a
9b
10a
10b
8a
8b
8c
8d
8e
8.1
8.2
7.1
7.2
7.3
1.1
1.2
2.1
2.2
2.3
3.1
3.2
4.1
4.2
4.3
5.1
5.2
6.1
6.2
9.1
9.2
v1
v2
v3
v4
v5
v6
T
1
2
3
4
5
6
10
11
12
13
16
17
18

DRAFTING ARRANGEMENT WITH FEEDBACK DRIVE GROUPS

This application is a continuation, of application number 07/552,491, filed Jul. 16, 1990, now abandoned.

BACKGROUND OF THE INVENTION

1. Field of the Invention

The present invention finds application in the textile field and relates to a draw frame with a main control and at least one auxiliary control and to a method for the operation of a drafting arrangement according to the apparatus as claimed.

Various devices and control devices for the comparison of fiber slivers are known, which are based on the principle of the drafting of the sliver. As a fuel, the slivers, doubled in a two-stage drafting process, are compared in a break draft and a main draft. Within the framework of the drafting process, with which several slivers are normally doubled at the same time, the aim is the production of a fiber sliver which is as homogeneous as possible. In the appropriate draw frame, slivers with irregularities or disturbances on the entry slide should be gathered together on the output side as a sliver with a predetermined cross section which is as uniform as possible. This requirement implies a control of the drafting process. The most widely different drive arrangements which decal with this problem exist at the existing state of technology as well as feed back and control devices.

Problems arise with the existing developments of driving arrangements and devices. The disturbances and fluctuations caused by the drive were certainly taken into account through known controls. To be sure, it was shown that consideration of the appropriate disturbances in the framework of a single main or total control required compensation in a very large control range, which demanded too much from conventional devices. At the same time, a disadvantage lay in that the total calculation load was concentrated and time dependencies of the controls were not optimized.

SUMMARY OF THE INVENTION

Therefore, an object of the invention is to develop a draw frame and method for the operation of a draw frame which avoids the above mentioned disadvantages and which permits optimum comparison of the sliver, after setting the guide magnitudes for the control of an automatic operating sequence.

Now in order to implement this object and others which will become more readily apparent as the description proceeds, the textile machine, such as a draw from or combing machine, with a main control for a drafting arrangement, comprises at least one independent drive group for at least one drafting zone, and each such independent drive group contains an auxiliary closed loop control system with an individual or separate controller, the auxiliary closed loop control system serving for the transfer of data from the individual or separate controller to the independent drive group and from the independent drive group to the individual or separate controller.

On the basis of the following drawings, the method according to the invention and an embodiment of the device are explained in more detail.

DETAILED DESCRIPTION OF THE PREFERRED EMBODIMENTS

Figure 1:
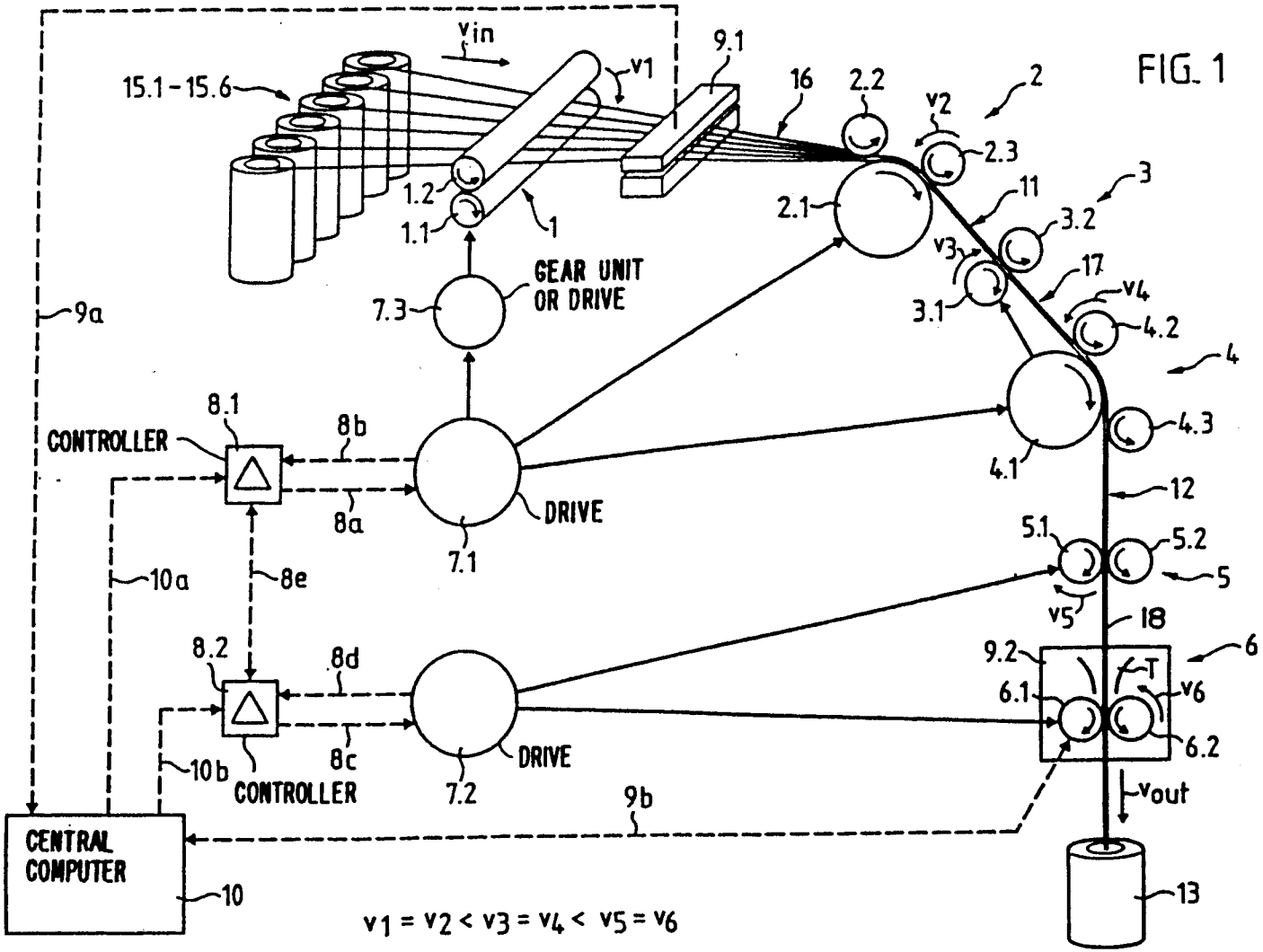
FIG. 1 is a schematic drafting arrangement with preliminary and main drafting sections and the principal measuring devices.

FIG. 1 is a schematic representation of an embodiment of the draw frame. Several fiber slivers 15.1–15.6, are brought together next to each other into a loose fleece and fed through several roller systems. Through this, the peripheral speed of the rollers in the transport direction of the fiber material increases in two operating phases or steps, is, that fiber materials is break drafted (preliminary draft) during the operating phase or first step and then is drawn further during the second step to the desired cross section (main draft). The fleece 18 emerging from the draw frame is thinner than the infed slivers 15.1–15.6 and correspondingly longer. Thereby, as the break drafting operations can be controlled as a function of the slivers fed in, the slivers or the fleece are compared during the passage through the draw frame, that is, the cross section of the fleece emerging is more even than the cross section of the fleece or the slivers fed in. The present draw frame has a break draft zone 11 and a main draft zone 12. Naturally, the invention can also be used in the same way with draw frames with one or more than two, drafting zones.

The slivers 15.1–15.6 are fed into the draw frame from two conveyor rollers 1.1 and 1.2. A first system 1 consists, for example, of two rollers 1.1 and 1.2, between which the slivers 15.1–15.6 are brought together into a loose fleece and transported. A roller system 2 follows in the transport direction of the slivers which consists here of one active conveyor roller 2.1 and two passive conveyor rollers 2.2, 2.3. during the feeding through the roller systems 1 and 2, slivers 15.1–15.6 fed in are brought together next to each other to form fleece 16. The peripheral speeds $v_1$ and $v_2$ ($=v_{in}$) of all rollers of the two roller systems 1 and 2 are the same, so that the thickness of fleece 16 corresponds substantially to the thickness of the slivers 15.1–15.6 fed in.

A third systems 3 of the feed follows on the roller system 1 ad 2 in the transport direction of the fleece 16 from break draft rollers 3.1 and 3.2, between which the fleece is further transported. The peripheral speed $v_3$ of the break draft rollers is higher than that of entry rollers $v_1$, $v_2$, so that the fleece 16 is drawn in the break draft zone between entry rollers 2.1, 2.2 and 2.3 and the break draft rollers 3.1 and 3.2, whereby its cross section is reduced. At the same time, a break drafted fleece 17 results from the loose fleece 16 of the slivers fed in. A further system 4 follows on the break draft rollers 3.1 and 3.2 of the further transport of the fleece, consisting of an active conveyor roller 4.1 and two passive conveyor rollers 4.3, 4.3. The peripheral speed $v_4$ of the conveyor rollers 4 for the further transport is the same as $v_3$of the break draft rollers 3.

a fifth system of main drafting rollers 5.1 and 5.2 for the further transport 4 follows the roller system in the transport direction of the fleece 17. The main break draft rollers 5.1 and 5.2 a higher surface speed 5, than the preceding transport rollers, so the the break drafted fleece 17 is drafted further to a finished drafted fleece 18 between the conveyor or transport rollers 4.1, 4.2 and 4.3 and the main drafting rollers 5.1 and 52. in the main drafting zone 12, whereby the fleece is brought together to a sliver through a funnel T.

The finished drawn sliver 18 is transported away from the draw from are between a pair of delivery rollers 6.1, 6.2, their peripheral speed $v_6$ ($=v_{out}$), is the same as that of the preceding main drafting zone ($v_5$) and laid into rotating cans 13, for example.

The roller systems 1, 2 and 4 are driven by a servo-motor 7.1 through a gear unit, preferably over toothed belts generally represented by the depicted arrows. The break draft rollers 3.1 and 3.2 are mechanically coupled with the roller system 4, whereby the ratio can be adjusted or a nominal value can be predetermined. The bear unit (not visible in the figure) determined the ratio between the peripheral speed of the inlet rollers ($v_{in}$) and the peripheral speed $v_3$ of the break draft rollers 3.1, 3.2, and consequently, the break draft ratio.

The roller systems 5 and 6 are driven by a servo-motor 7.2. The inlet rollers 1.1, 1.2, can likewise be driven over the first servo-motor or optionally over an independent motor 7.3. The two servo-motors 67.1 an 7.2 each have a respective or individual controller 8.1 or 8.2. The control is effected in each case over a closed loop control system 8*a*, 8*b*, or 8*c*, 8*d*. In addition, the nominal value of one servo-motor 7.1 or 7.2 can be transmitted to the other servo-motor 7.2 or 7.1 in one oe both directions over a control connection 8*e*, so that in the case f deviation in one servo-motor, the other can react correspondingly.

The total cross section of the infed slivers, 15.1–15.6, is measured at the inlet of the draw frame by an inlet measuring device 9.1. At the outlet of the draw fame, the cross section of the sliver 18 emerging can then be measured by an outlet measuring device 9.1.

a central computer unit 10 transmits an initial setting of the nominal size of the first drive via 10*a* to the first controller 8.1. The measured variables of the two measuring devices 9.1, 9.2 are continuously transmitted to the central computer unit 10 during the drafting process over connections 9*a* and 9*b*. The nominal value for the servo-motor 7.2 and any further nominal values required are determined from these measurement results and from the nominal value for the cross section of the sliver 18 emerging by the central computer unit 10 by means of the method according of the invention. This nominal value is continuously delivered via 10*b* to the second controller 8.2. With the aid of this control system, fluctuations in the cross section of the slivers 15.1–15.6, can be compensated through the appropriate regulation of the main drafting zone or a comparison of the slivers can be effected.

Figure 2:
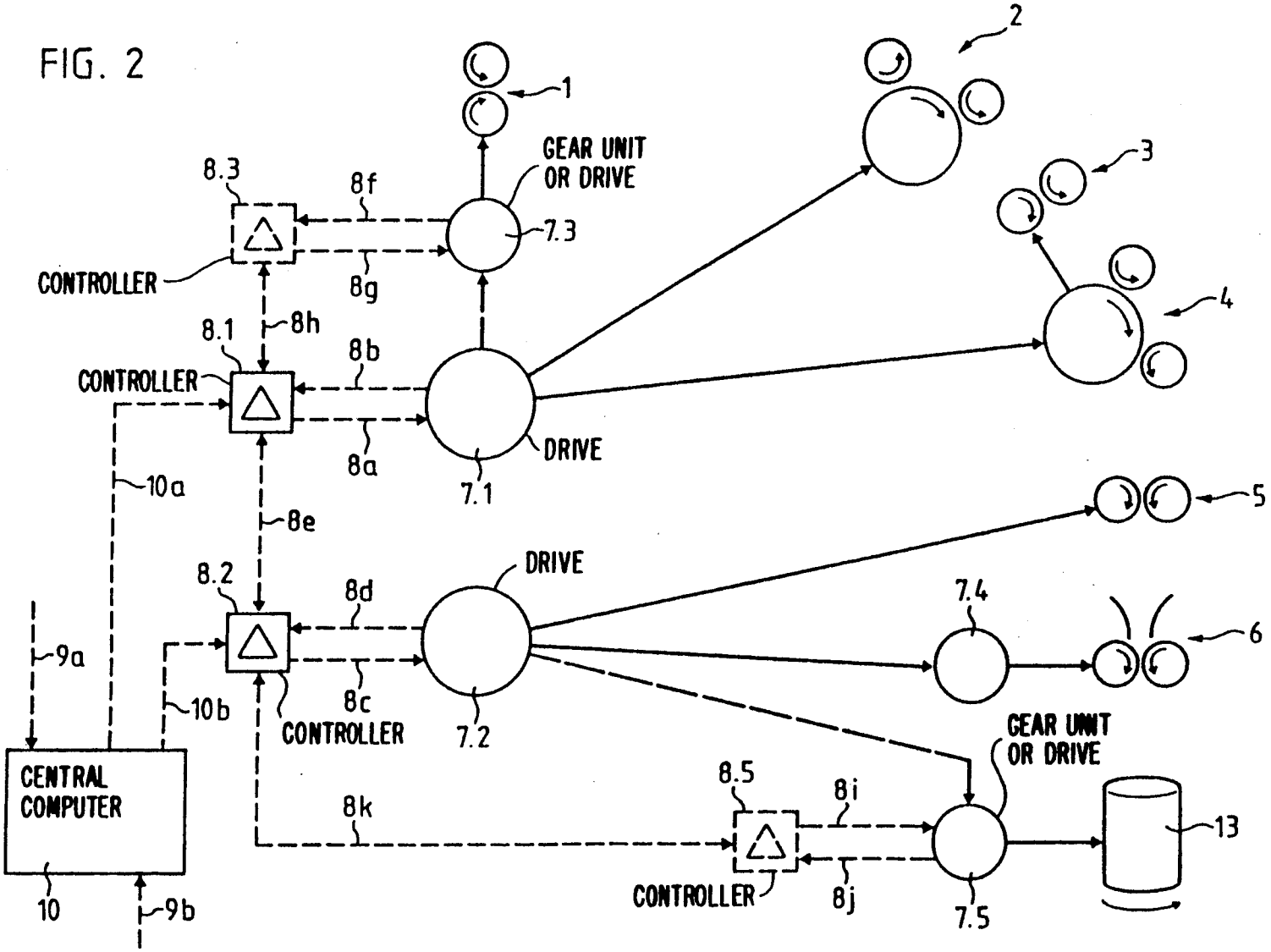
FIG. 2 is a schematic view of the drive arrangement and appropriate controllers according to the invention.

The drive plan with its control according of the invention is explained in greater detail with the aid of FIG. 2. The two servo-motors 7.1 and 7.2 serve principally as the main drive. The servo-motor 7.1 drives roller system 1 of inlet, and system 4 drives the conveyor rollers, which follow the break draft section. The break draft pair of rollers 3.1 and 3.2 is mechanically coupled with roller system 4 and is also driven from the servo-motor 7.1. The two rollers 1 at the inlet are driven either by an intermediate drive 7.3 constituting a gear unit for the servo-motor 7.1, or can be driven with another variant of the draw frame drive from an independent independent drive 7.3 constituting an independent drive motor. The servo-motor 7.2 drives the main draw pair of rollers 5 directly. The funnel wheel pair 6 are driven ia a gear unit 7.4 from servo-motor 7.2. The drive for the cans 13 at the outlet of the draw frame is effected via an intermediate drive (gear unit) or according to another embodiment by means of an independent drive 7.5 constituting an independent driving motor.

The drive plan is based on the fact that at least one drive group within the draw frame is driven independently from a motor. A motor is provided for every independent drive group of a break draft zone or a motor is also provided for each of the requirements of a conveying or transport section or some other working position connected with the process; for example, there are two of these in FIG. 2, represented namely the motors 7.1, 7.2 of the break draft zone 11 and the main drafting zone 12. Basically, disturbances are compensated which are caused through the drives, within the framework of the total system control, that is, the main control. It has been shown, however, as an advantage of the invention, that every drive group should be controlled independently, that is, a multi-loop control system with appropriate controllers 8.1, 8.2 is provided. The deciding factor is that the control deviations of the total system which appear are influenced to advantage and improved time dependency is achieved, or possible disturbances are compensated in advance. Such drive units with auxiliary controller or regulators 8.1, 8.2 can be incorporated in various main control plans.

The drafting arrangement drive is controlled on two levels, one being the central main controllers 9*a*, 9*b*, 10*a*, and 10*b* in which the central computer unit 10 plays an important function and another level with at least one subordinate auxiliary controller 8.2 for the main draft zone. In the present case, two controllers 8.1 and 8.2 are provided for the auxiliary control as well as for the main drafting zone (including the outlet zone) and also for the break draft zone (including the inlet zone). In the variants already explained, additional controllers 8.3, 8.5 can be provided which are shown with broken lines here. Preferably, position controllers are used in conjunction with the two servo-motors, which, for example, can be brushless direct current motors. The central computer unit 10 is relieved through the multi-loop control with a main control and at least one auxiliary control and the risk of the appearance of large modulations with the main control is reduced.

The main regulation or controllers 9*a*, 9*b*, 10*a*, and 10*b*, supply nominal values, for example, nominal speed values, to the main driving moors 7.1 or 7.2, which are calculated from the nominal cross section of the emerging sliver and from the measured actual cross section of the sliver fed in or of the slivers as inputted at fed in 9.1 9*a* and the merging sliver as inputted at 9.b. Further parameters can be considered, each according to the development of the desired control.

By means of the auxiliary controls 8*a*–8*k*, the speeds of the individual driving motors 7.1 and 7.2 (also 7.3 and 7.5) are controlled in closed loop control systems 8*a*, 8*b*, and 8*c*, 8*c* (also 8*f*, 8*g* and 8*i*, 8*j*) on the basis of the nominal values required on the upper control level. Differences between he actual and nominal values of the motor speeds are transmitted via a control connection 8*e* between the position controllers 8.1, 8.2 (possibly also 8*k* and 8*h*). Additionally a deviation lying outside the control range of the affected controller 8.1 or 8.2 (also possibly controllers 8.3 or 8.5) between the nominal and actual value of the speed of the affected motor can be compensated by the position controller of the other motor through appropriate correction of the nominal value for the speed of the other motors. In this case, an appropriate control loop to the central computer unit 10 can be provided. In a preferred embodiment, this correction is effected internally in the appropriate controllers.

The driving motors, which determine the drafting, each form with their appropriate control loops a position controlled driving system. In additional, every motor can be provided with an encoder or a resolver, which gives the angular position of the driving shaft at any time as an actual value with predetermined accuracy to the position controller for this motor. The control of the draw frame can mutually co-ordinate the angular position of the moor shaft over this position control loop and with it the rollers of the draw frame driven from it.

a drive system of this type allows considerably improved drafting accuracy more than that which could be achieved through motors with speed control. At the same time, the use of position controllers as auxiliary, controls (not rotational speed control) offers an advantage in that control is assured in the case of a stoppage of the motor. There are advantages to ge gained when starting or slowing the draw frame, as considerably improved control accuracy is possible with low rotational speed until standstill.

The invention does not exclude the use of motors with speed control for certain rollers determining the draft, as such motors also make a considerable improvement possible compared with the existing state of technology.

Position controllers (not speed controllers) are fitted as controllers within the framework of the auxiliary control, as these assure control also in case of a stoppage of the motor. The appropriate controllers 8.1, 8.2 (or possibly other controllers in the framework of other embodiments) can contain separate computer units (for example,. with digital signal processors or microprocessors) or they can also be developed as a module of the central computer unit 10.

In the present invention one proceeds on the basis that independent drive units or groups of the draw frame can be separately controlled. As a drive group, a unit contains at least one motor, inclusive of the rollers, guide or transport rollers driven by this unit. A drive group of this type is represented in an embodiment according to FIG. 2, for example, in which groups 7.2, 7.4, 7.5, 5 and 6 contain the motor. A preferred embodiment of the draw frame envisions a digital synchronous control of the drive groups for the nominal settings. Thereby, one drive groups serves as the master group. The control of a drive group can be achieved by the alteration of the nominal setting.

Through this, it is possible that the total control system gives only the nominal value for the size, that is, the value or a correction size for the draft. Against this, it should be considered that the main control, according to the invention, should compensate short term as well as gradual disturbances. The drive system according to the invention makes a multi-loop control system possible and utilizes the improved time dependency. The control connections 8*a*, 8*h*, 8*k* likewise make a shorter reaction time possible. Divergencies of the drive system must not first be acquired over a close loop control system with a corresponding dead time.

A separate control of very drive group has considerable advantages, especially when several draft zones are envision, from which, however, only one, or a part of one, should be, or must be controlled. Those zones with constant drafting can be operated solely with nominal values, without control which must result through the main control.

The control principle according to the invention ensures an excellent comparison, also with unexpected alternations of the operating conditions. Short term disturbances, as well as gradual alterations can be compensated to the maximum in the framework of this control. The actuating variable, determined by the main control, here for example, for the main draft, serves as an inlet magnitude for the appropriate controller 8.2.

For the sake of completeness, it must be stated that the method according to the invention is suitable for all devices of the textile industry which require control of a drafting process.

What is claimed:

1. A textile machine comprising:

a drafting arrangement containing at least one drafting zone;

at least one independent drive group for operating the at least one drafting zone;

individual controller means provided for each said at least one independent drive group;

means defining an auxiliary closed loop control system provided for said at least one independent drive group for the transfer of data pertinent to the operation of said at least one drafting zone from said individual controller means to said at least one independent drive group and from said at least one independent drive group to said individual controller means;

said drafting arrangement containing at least two drafting zones comprising a break drafting zone and a main drafting zone;

said at least one independent drive group comprises at least two independent drive groups defining a first independent drive group and a second independent drive group;

said first independent drive group comprises a first drive for the main drafting zone;

said second independent drive group comprises a second drive for the break drafting zone;

said individual controller means comprises a first individual controlled provided for said first drive for the main drafting zone and a second individual controller provided for the second drive for the break drafting zone;

said means defining an auxiliary closed loop control system provides a first auxiliary closed loop control system for said first drive for the main drafting zone and a second auxiliary closed loop control system for the second drive for the break drafting zone;

said first auxiliary closed loop control system serving for the transfers of data pertinent to the operation of said main drafting zone from said first individual condoler to said first drive for the main drafting zone and from said first drive for the main drafting zone to said first individual condoler for the main drafting zone;

said second auxiliary closed loop control system serving for the transfer of said pertinent to the operation of said break drafting zone from said second individual controller to said second drive for the break drafting zone and from said second drive for the break drafting zone to said second individual controller for the break drafting zone; and control connection means for operatively interconnecting the first and second individual controllers with one another.

2. The textile machine according of claim 1, wherein:

each said first individual controller and said second individual controller comprise position controllers.

3. The textile machine according to claim 1 wherein:

the textile machine comprises a draw frame;

at least one further independent drive group selectively provided or any one of a conveyor, a transport section or a work station coupled with the draw frame;

a third individual controller provided for said at least one further independent drive group; and means defining an auxiliary closed loop control system provided for said at least one further independent drive group for the transfer of data from said third individual controller to said at least one further independent drive group and from said at least one further independent drive group to said third individual controller.

4. The textile machine according of claim 3, further including:

control connection means for interconnecting said third individual controller of said at least one further independent drive group with said second individual controllers of said second drive for the break drafting zone.

5. A textile machine, comprising:

a drafting arrangement containing at least two drafting zones comprising a break drafting zone and a main drafting zone;

a first independent drive group comprising a first drive for the main drafting zone;

a second independent drive group comprising a second drive for the break drafting zone;

a first position controller provided for said first drive for the main drafting zone;

a second position controller provided for the second drive for the break drafting zone;

means defining a first auxiliary closed loop control system for said firs drive for the main drafting zone;

said first auxiliary closed loop control system serving for the transfer of data pertinent to the operation of said main drafting zone from said first position controller to said first drive for the main drafting zone and from said first drive for the main drafting zone to said first position controller for the main drafting zone;

means defining a second auxiliary closed loop control system for the second drive for the break drafting zone; and said second auxiliary closed loop control system serving foe the transfer of data pertinent to the operation of said break drafting zone from said second position controller to said second drive for the break drafting zone and from said second drive for the break drafting zone to said second position controller of the break drafting zone.

6. The textile machine according to claim 5, further including:

control connection means for operatively interconnecting the first and second position controllers with one another.

7. A method of operating a draw frame comprising a drafting arrangement containing at least two drafting zones comprising a break drafting zone and a main drafting zone, said method comprising the steps of:

inputting a first predetermined reference operating parameter for the first individual controller for a first drive for the main drafting zone;

inputting a second predetermined reference operating parameter for a second individual controller for a second drive for the break drafting zone;

feeding textile material through the drafting arrangement;

drafting the textile material in the drafting arrangement;

transferring data pertinent to the operation of said main drafting zone from said first individual controller to said first drive of the main drafting zone and from said first drive for the main drafting zone to said first individual controller for the main drafting zone;

transferring data a pertinent to the operation of said break drafting zone from said second individual condoler to said second drive for the break drafting zone and from said second drive for the break drafting zone to said second individual controller for the break drafting zone;

maintaining constant the operation of the first drive during such time as the first drive operates in accordance with the first predetermined reference operating parameter for the first individual controller;

maintaining constant the operation of the second drive during such time as the second drive operates accordance with the second predetermined reference operating parameter of the second individual controller;

monitoring the drafting of the textile material with respect to at least one predetermined characteristic;

upon deviation of the at least predetermined characteristic of the textile material from a reference value altering at least one of the predetermined reference operating parameters of an associated one of the individual condoler; and altering the operating of the drive of the associated individual controller as a function of the alteration of said at least one of the predetermined reference operating parameters of the associated individual controller.

8. The method of operating a draw frame according to claim 7, further including the steps of:

altering the predetermined operating parameter of the other individual controlled upon exceeding a predetermined regulation range of said associated individual controller.

* * * * *